United States Patent [19]

Hosoi

[11] Patent Number: 4,703,588

[45] Date of Patent: Nov. 3, 1987

[54] DRILL CUTTING EDGE GRINDER

[76] Inventor: Toshiaki Hosoi, 9-10, Kami-minami 5 chome, Hirano-ku, Osaka, Japan

[21] Appl. No.: 809,083

[22] Filed: Dec. 12, 1985

[30] Foreign Application Priority Data

Dec. 19, 1984 [JP] Japan ..... 59-269167

[51] Int. Cl.[4] ..... B24B 19/00

[52] U.S. Cl. ..... 51/219 PC

[58] Field of Search ..... 51/219 R, 219 PC

[56] References Cited

U.S. PATENT DOCUMENTS 4,001,975 1/1977 Bernard et al. ..... 51/219 PC X 4,261,142 4/1981 Nixon et al. ..... 51/219 PC X 4,544,310 10/1985 Tyynela et al. ..... 51/219 PC X

*Primary Examiner*—Frederick R. Schmidt

*Assistant Examiner*—Debra S. Meislin

*Attorney, Agent, or Firm*—Jordan and Hamburg

[57] ABSTRACT

A cutting edge grinder for grinding the cutting edges of drills includes a center shaft coaxial with a chuck to hold a drill to be ground, a cam attached to the center shaft, a movable frame to hold the center shaft so as to turn freely, a guide member to guide the movable frame in an inclined direction from the center of the center shaft, a turning means to turn the center shaft, and a pressing member to come in contact with the cam face of the cam, such that simple and accurate grinding of curved cutting edges of different shapes is made possible.

8 Claims, 3 Drawing Figures

Fig. 2
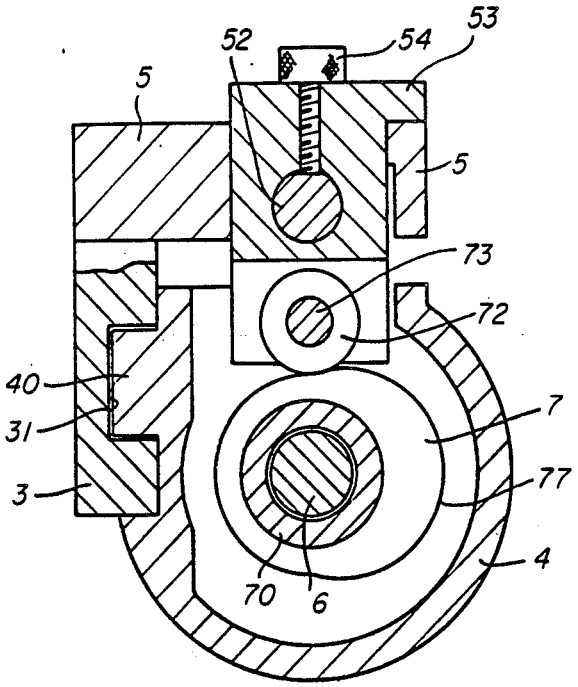
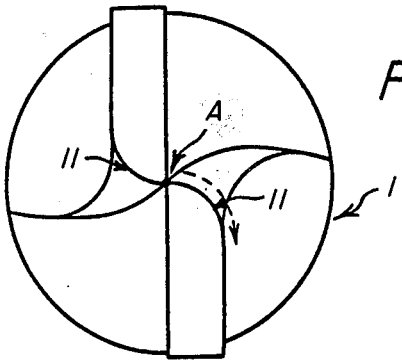
Fig. 3

DRILL CUTTING EDGE GRINDER

DETAILED DESCRIPTION OF THE INVENTION

This invention relates to a cutting edge grinder of simple composition which enables accurate grinding of curved cutting edges of drills.

PRIOR ART

Recently drills with curved cutting edges viewed from the base are being used, and the grinding equipment for the curved edge is very intricated and expensive. In using such drills, it is frequently necessary to grind the cutting edge which becomes worn out during operation, and development of a simple device for grinding the worn out edges has been desired. The cutting edges are in different shapes and of different kinds depending on each drill size and other conditions, and it is desirable to grind curved cutting edges of different shapes by a single machine.

OBJECT OF THE INVENTION

An object of the present invention is to provide a cutting edge grinder which can grind the rake face of cutting edges of intricate shape.

Another object of the invention is to provide a grinder for curved cutting edges of drills made of a simple construction and at a low cost.

A further object of the invention is to provide a grinder which is applicable to grinding curved cutting edges of different shapes.

To realize these objects, the grinder of the present invention comprises a center shaft coaxial with the chuck to hold a drill to be ground, a cam attached to said center shaft, a movable frame to hold said center shaft so as to turn freely, a guide member to guide said movable frame in an inclined direction from the center of said center shaft, a means to turn said center shaft, and a presser held by a fixed frame and put in contact with the face of said cam.

Said presser is held by said fixed frame so as to move freely in an axial direction of said cam and the face shape of said cam changes in the axial direction so that the locus of travel of the cutting edge of a drill held by said chuck changes according to each setting position of the presser.

Other features and advantges of the invention will appear from the detailed description of a preferred embodiment of the invention given below.

FIG. 2 is a sectional view taken along line II—II shown in FIG. 1.

FIG. 3 illustrates the base of a drill ground by said grinder.

PREFERRED EMBODIMENT

Figure 1:
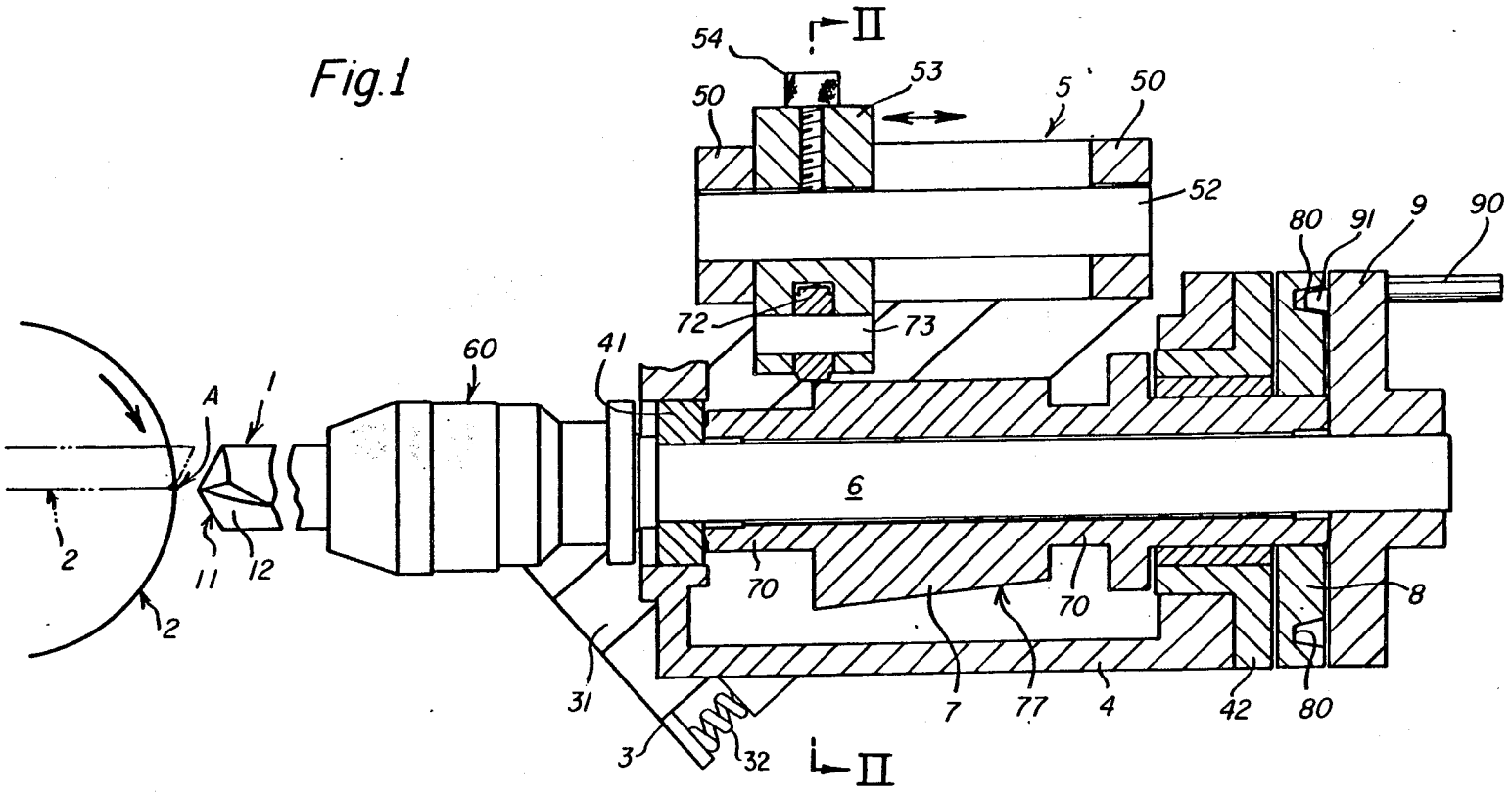
FIG. 1 is a general section of a grinder according to one embodiment of the present invention.

In FIG. 1 to FIG. 3, the equipment to grind the curved cutting edge 11 of a drill 1 with the grinder 2 has a movable frame 4, a guide member 3, and a fixed frame 5. The movable frame 4 holds a center shaft 6 so as to turn freely, and a sleeve 70 comprising a cam 7 is fitted to the outside of the center shaft 6. The center shaft 6 and the sleeve 70 are fitted to each other so as to turn relative to one another. The center shaft 6 is held by a bearing 41 at the front end, and at the rear end, the sleeve is held by a bearing 42. A flange 8 is attached to the rear end of the sleeve 70. At the front end of the center shaft 6, a chuck 60 is attached coaxially with the center shaft 6, and the drill 1 to be ground is held by the chuck 60. To the rear end of the center shaft 6, an operation flange 9 having an operation handle 90 for turning is fixed. Flange 9 is rotatably fixed and longitudinally slidable on shaft 6. A projection 91 formed on the operation flange 9 is fitted into detents 80 made on the flange 8 to turn the center shaft 6 which is rotatably fixed to the flange 9, and the rotary power is also transmitted to the sleeve 70 through the flange 8. The detents 80 are made as a set at point symmetry positions. By inserting the projection 91 into the detents 80 alternatively, a pair of cutting edges 11 formed symetrically can be ground alternatively as detailed below.

The fixed frame 5 is provided with bearings 50, a shaft 52 going through an adjusting member 53 is held and fixed by the bearings 50 at both ends, and the adjusting member 53 is so constructed so as to move along the shaft 52 as shown by the arrow in FIG. 1. The adjusting member 53 can be fixed at a desired position by a stop pin 54. A presser roller or pressing member 72 is attached to the adjusting member 53 by a pin 73, and the presser roller 72 is put in contact with the cam face 77 of the cam 7. With changing shape of the cam face 77 in an axial direction the cam 7 is so constructed that the locus of travel of the cutting edge 11 of the drill 1 held by the chuck 60 changes according to the setting position (the position coming in contact with the cam face 77 of the presser roller 72. The shape of the cam 7 is formed so that the presser roller 72 pressed onto the cam face 77 as described below, causes the grinder 2 come in contact with the rake face 12 of the cutting edge 11 when the drill 1 travels.

The guide member 3 is fixed to a side of the movable frame 4 and a projection 40 of the movable frame 4 is inserted in a guide groove 31 in such a manner as to move freely and to guide the movable frame 4 in an inclined direction relative to the axial direction of the center shaft 6.

The adjusting member 53 is movable along the shaft to enable grinding of cutting edges of several kinds. It is also possible, however, to fix the adjusting member to grind drills of the same shape exclusively.

As for operation of this grinder, a drill 1 to be ground is held by the chuck 60, and adjusting member 53 is moved along the shaft 52 and is fixed at a specified position by the stop pin so that a specified locus of travel is obtained according to the shape of the cutting edge 11. Under this condition, the movable frame 4 is pushed upward aslant along the guide groove 31 by springs 32 (not illustrated). Accordingly, the presser roller 72 is pressed onto the cam face 77 at a specified position. When the handle 90 of the operation flange 9 is turned, the cam 7 turns with the center shaft 6, the presser roller 72 pressed onto the cam face 77 pushes the cam 7 downward as the outside diameter of the cam 7 increases, the movable frame 4 travels along the guide groove 31, and the presser roller 72 moves on the cam face 77 in spiral way. Accordingly, the drill 1 moves downward aslant while turning toward the grinder 2. FIG. 3 shows the relationship between a fixed point A and the cutting edge 11 under this condition. As the drill 1 makes a turn, the fixed point A moves on the cutting edge 11 in a peripheral direction as shown by the broken line arrow. In other words, the grinder 2 of which center is turning at a fixed position relative to the rake face 12 of the curved cutting edge 11 comes in contact while increasing the contact surface gradually from the center to the periphery, and the cylindrical curved face of rake 12 is ground.

After grinding the rake face 12 at the center, the handle 90 is operated for revolution in a reverse direction, then the movable frame 4 is moved along the guide groove 31 by the spring 32 to return to the original position. The movable frame 4 is stopped accurately at the original position by a stopper (not illustrated). Then the operation flange 9 is moved backward a little in an axial direction to release the projection 91 from the detent 80 and is inserted into the other detent 80 after turning 180°, the cam 7 is kept at the original position and the center shaft 6 and the drill 1 coaxial with the center shaft are turned 180°. When the same operation as described above is repeated under this condition, grinding of the rake face 12 of the other cutting edge 11 of the drill 1 is made in the same manner.

Curvature of the cutting edge 11 differs according to drill thickness, and to grind cutting edges of different curvatures, the stop position of the adjusting member 53 is changed according to each curvature. When the adjusting member 53 is moved on the shaft 52, the position of the presser roller 72 in axial direction on the cam face 77 changes, and the locus of travel of the roller 72 on the cam face 77 in a spiral way changes. Accordingly, the locus of travel of the cutting edge of the drill attached coaxially with the center shaft (locus of contact on the grinder 2) changes.

In some cases, single cam 7 may not be suitable for the shape of the drill cutting edge. In such a case, the cam is changed with another cam of different shape. When the grinder 2 is worn out, adjust position of the grinder 2 according to the degree of wear so that grinding of a specific curved face can be made at all times.

As described above, this grinder can grind rake faces of curved cutting edges of intricate shapes accurately simply by turning the operation handle. The same grinder is applicable to accurate grinding of curved cutting edges of different shapes by changing the cam shape in an axial direction and by adjusting the position of the presser member to the cam.

As explained so far, the grinder of the present invention is composed of a center shaft coaxial with a chuck to hold a drill to be ground, a cam attached to the center shaft, a movable frame to hold the center shaft so as to turn freely, a guide member to guide the movable frame in an inclined direction from the center of the center shaft, a turning means to turn the center shaft, and a pressing member to come in contact with the cam face of the cam, such that simple and accurate grinding of curved cutting edges of different shapes is made possible by the simple composition.

I claim:

1. A drill holding and positioning device for holding and positioning a drill relative to a grinding wheel to effect grinding of the curved cutting edges of the drill, comprising a fixed frame and a movable frame, guide means for mounting said movable frame on said fixed frame for relative movement along a path, a center shaft rotatably mounted on said movable frame, a chuck coaxially carried by said center shaft for holding a drill to be ground, said center shaft having a longitudinal axis which is disposed at an acute angle relative to said path, a cam means mounted on the outside of said shaft for rotation relative to said center shaft, turning means operably connected between said center shaft and said cam means for connecting said cam means and center shaft for simultaneous rotation, a cam follower means mounted on said fixed frame, and spring means between said fixed and movable frame biasingly urging said movable frame in one direction along said path, whereby the spring means biasingly urges said cam means against said cam follower means such that rotation of the cam means moves said movable frame along said path and the curved cutting edges of said drill are ground by said grinding wheel during said movement of said movable frame along said path.

2. A drill holding and positioning device according to claim 1, wherein said cam means extends longitudinally in a direction parallel to the longitudinal axis of said center shaft, said cam follower means comprising a cam follower element which engages said cam means and a cam adjusting means for displacing said cam follower element parallel to the longitudinal axis of said cam means to engage different longitudinal sections of said cam means.

3. Drill holding and positioning device according to claim 1, wherein said cam means extends longitudinally in a direction parallel to the longitudinal axis of said center shaft, said cam follower means comprising a cam follower support mounted on said fixed frame and a cam follower adjusting means movably mounted on said cam follower support for movement in a direction parallel to the longitudinal axis of said cam means, said cam follower means further comprising a cam follower roller carried by said cam follower adjusting means such that said cam follower roller is displaceable parallel to the longitudinal axis of said cam means to engage different longitudinal sections of said cam means, whereby the movement of said movable frame along said path is variable by adjusting said cam follower adjusting means.

4. A drill holding and positioning device according to claim 1, wherein said turning means comprises adjusting means interposed between said center shaft and said cam means for adjusting the relative rotatable position between said center shaft and said cam means.

5. A drill holding and positioning device according to claim 1, wherein said center shaft has a radial flange, said cam means having a radial flange juxtaposed to said radial flange on said center shaft, said turning means comprising at least two detents in one of said flanges and a projection in said other flange, said projection being movable relative to said detent to one position wherein said projection engages one of said detents to thereby rotatably connect said two flanges together and to another position wherein said projection is disengaged from said detents to thereby permit relative rotation between said two flanges, whereby the rotatable position of said cam means relative to said center shaft is thereby changeable.

6. A drill holding and positioning device according to claim 5, wherein there are two of said detents in said one flange and said two detents are spaced 180° apart to thereby provide for rotation of said cam means 180° relative to said center shaft.

7. A drill holding and positioning device for holding and positioning a drill to effect grinding of the curved cutting edges of the drill, comprising a grinding wheel for grinding the curved edges of the drill, a fixed frame and a movable frame, said guiding wheel being rotatable about a rotatable axis which is in a fixed position relative to said fixed frame, guide means for mounting said movable frame on said fixed frame for relative movement along a path, a center shaft rotatably mounted on said movable frame, a chuck coaxially carried by said center shaft for holding the drill to be ground, said center shaft having a longitudinal axis which is disposed at an acute angle relative to said path, a cam means mounted on the outside of said center shaft for rotation relative to said center shaft, turning means operably connected between said center shaft and said cam for connecting said cam means and center shaft for simultaneous rotation, said turning means comprising adjusting means interposed between said center shaft and said cam means for adjusting the relative rotatable position between said center shaft and said cam means, a cam follower means mounted on said fixed frame, and spring means between said fixed and movable frame biasingly urging said movable frame in one direction along said path, whereby the spring means biasingly urges said cam means against said cam follower means such that rotation of the cam means moves said movable frame along said path in a direction opposite to said one direction and the curved cutting edges of said drill are ground by said grinding wheel during said movement of said movable frame along said path.

8. A drill holding and positioning device for holding and positioning a drill relative to a grinding wheel to effect grinding of the curved cutting edges of the drill, comprising a fixed frame and a movable frame, guide means for mounting said movable frame on said fixed frame for relative movement along path, a center shaft rotatably mounted on said movable frame, a chuck coaxially carried by said center shaft for holding a drill to be ground, said center shaft having a longitudinal axis which is disposed at an acute angle relative to said path, a cam means mounted on the outside of said center shaft for rotation relative to said center shaft, said cam means extending longitudinally in a direction parallel to the longitudinal axis of said center shaft, turning means operably connected between said center shaft and said cam means for connecting said cam means and center shaft for simultaneous rotation, said turning means comprising adjusting means interposed between said center shaft and said cam means for adjusting the relative rotatable position between said center shaft and said cam means, a cam follower means mounted on said fixed frame, said cam follower means comprising a cam follower support mounted on said fixed frame and a cam follower adjusting means movably mounted on said cam follower support for movement in a direction parallel to the longitudinal axis of said cam means, said cam follower means further comprising a cam follower roller carried by said cam follower adjusting means such that said cam follower roller is displaceable parallel to the longitudinal axis of said cam means to engage different longitudinal sections of said cam means, whereby the movement of said movable member along said path is variable by adjusting said cam follower adjust means, and spring means between said fixed and movable frame biasingly urging said movable frame in one direction along said path, whereby the spring means biasingly urges said cam means against said cam follower roller such that rotation of the cam means moves said movable frame along said path and the curved cutting edges of said drill are ground by said grinding wheel during said movement of said movable frame along said path.

* * * * *